US005952967A

United States Patent [19]

Goetz et al.

[11] Patent Number: 5,952,967

[45] Date of Patent: Sep. 14, 1999

[54] LOW COST EVEN NUMBERED PORT MODEFORMER CIRCUIT

[75] Inventors: Allan C. Goetz, La Jolla; Robert G. Riddle, II, San Diego, both of Calif.

[73] Assignee: TRW Inc., Redondo Beach, Calif.

[21] Appl. No.: 09/181,370

[22] Filed: Oct. 28, 1998

[51] Int. Cl.[6] ..... H01Q 3/22; H01Q 3/24; H01Q 3/26

[52] U.S. Cl. ..... 342/373

[58] Field of Search ..... 342/373

[56] References Cited

U.S. PATENT DOCUMENTS

| | | | |
|---|---|---|---|
| 4,231,040 | 10/1980 | Walker . | |
| 4,633,259 | 12/1986 | Hrycak . | |
| 4,638,317 | 1/1987 | Evans . | |
| 5,373,299 | 12/1994 | Ozaki et al. . | |
| 5,532,700 | 7/1996 | Lockwood | 342/378 |
| 5,561,667 | 10/1996 | Gerlach . | |
| 5,691,728 | 11/1997 | Goetz et al. . | |
| 5,777,579 | 7/1998 | Goetz et al. . | |

*Primary Examiner*—Theodore M. Blum

*Attorney, Agent, or Firm*—Michael S. Yatsko

[57] ABSTRACT

The present invention provides a modeforming circuit (100). The modeforming circuit (100) includes a first matrix circuit (102) comprising an interconnected network of transmission lines (208–212) and phase shifters (216–218) that implement at least one N/2×N/2 identity matrix and at least one N/2×N/2 phase shift matrix. The first matrix circuit (102) is connected in series to a second matrix circuit (104). The second matrix circuit (104) includes an interconnected network of phase shifters that implements at least one N/2×N/2 phase shift matrix. The modeforming circuit (100) may further include a third matrix circuit (106) connected in series with the second matrix circuit (104). The third matrix circuit (106) includes a network of transmission lines (220–230) that reorder N inputs to N mode outputs. The first matrix circuit (102) may be implemented as a first matrix sub-circuit (108) connected in series with a second matrix sub-circuit (110) to provide even further reduced complexity. For example, the first matrix sub-circuit (108) may comprise an interconnected network of 180° degree hybrids (202–206). The second matrix sub-circuit (110) may then comprise an interconnected network of phase shifters (216–218).

20 Claims, 1 Drawing Sheet

LOW COST EVEN NUMBERED PORT MODEFORMER CIRCUIT

BACKGROUND OF THE INVENTION

The present invention relates to modeforming circuits for antennas. In particular, the present invention relates to a hardware implementation of a modeforming matrix decomposition that efficiently generates mode signals useful for direction finding and beamforming.

Cylindrically symmetric antennas are used in many applications involving, for example, direction finding and beamforming. In these applications, it is often useful to produce the analytic signals referred to as the "modes" of the antenna. In general, a cylindrical antenna with N arms or N input ports has N modes.

In the past, a Butler matrix has provided the circuitry by which the mode signals are produced. The Butler matrix, however, is restricted to antenna designs in which N equals a power of two (e.g., 8, 16, 32 . . . ). Thus, there is a wide range of antenna designs for which the Butler matrix cannot be used (namely, for odd N and even N not a power of 2). Furthermore, the Butler matrix is inefficient in its use of components that implement the phase shifting and signal processing functions that produce the mode signals, particularly as N increases. The complexity, cost, and unreliability of the antenna are correspondingly increased.

Additionally, in many situations, cost considerations may dictate that an antenna include fewer than the number of ports required by the standard Butler matrix. Because of the increasingly large gaps between powers of two (e.g., 16, 32, 64), past antennas requiring a particular performance level (e.g., achieved at N=34) had to bear the increased cost and complexity of using ports that corresponded to the next greatest power of two (e.g., N=64), or implement a design using ports corresponding to a first lesser power of two (e.g., N=32). Thus, compromises in cost and performance were required in the past with standard Butler matrix implementations.

Accordingly, there is a need in the industry for a modeformer circuit that provides reduced cost and complexity, and that may be used with antennas with any even number of arms.

BRIEF SUMMARY OF THE INVENTION

It is an object of the present invention to provide a modeforming circuit.

It is another object of the present invention to provide a modeforming circuit that may be used with an N port antenna for any even N.

Yet another object of the present invention is to provide a modeforming circuit that may be implemented with less complexity and cost than past Butler matrix modeforming circuits.

The present invention meets one of more of the above objects in whole or in part by providing a modeforming circuit for forming N mode signals from N input signals.

The modeforming circuit generally includes a first (Int) matrix circuit comprising an interconnected network of transmission lines and phase shifters that implement at least one N/2×N/2 identity matrix and at least one N/2×N/2 phase shift matrix. The first matrix circuit is connected in series to a second (GD) matrix circuit. The second matrix circuit includes an interconnected network of transmission lines and phase shifters that implements at least one N/2×N/2 phase shift matrix.

The modeforming circuit may further include a third (Poe) matrix circuit connected in series with the second matrix circuit. The third matrix circuit includes a network of transmission lines that reorder N inputs to N mode outputs. Thus, the N mode outputs may be conveniently arranged for connection to subsequent processing circuitry.

The first matrix circuit may be implemented as a first matrix sub-circuit connected in series with a second matrix sub-circuit to provide even further reduced complexity. For example, the first matrix sub-circuit may comprise an interconnected network of 180 degree hybrids. The second matrix sub-circuit may then comprise an interconnected network of phase shifters.

DETAILED DESCRIPTION OF THE INVENTION

Figure 1:
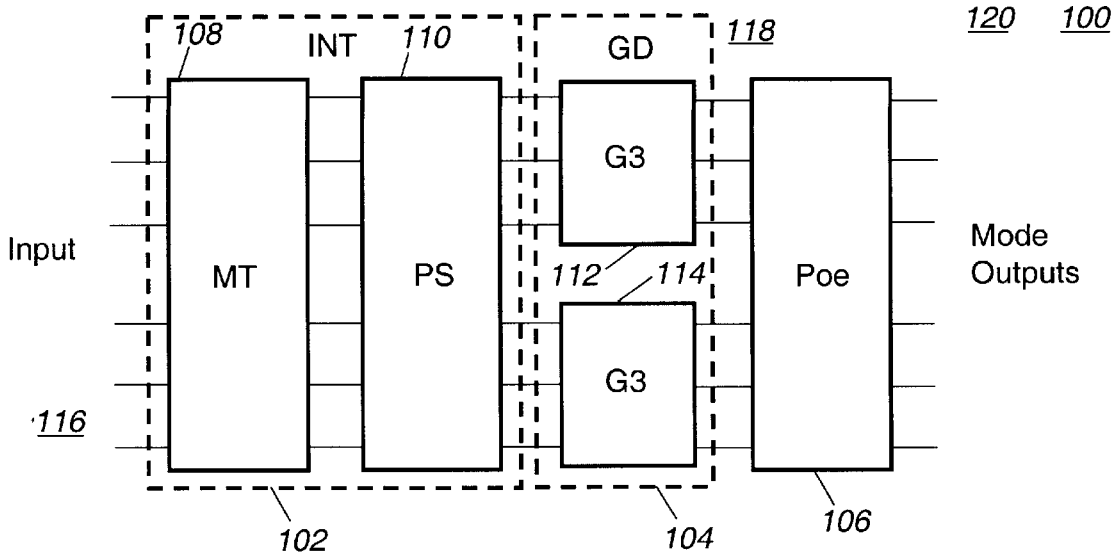
FIG. 1 illustrates one implementation of the present modeformer circuit for N=6.

An analog signal processing function performed by a matrix modeformer with N input ports may be represented as a matrix transformation of the N analytic signals present at the N inputs according to an N×N complex matrix given by:

$$(GN)_{mn} = \frac{1}{\sqrt{N}} e^{im^* n^* \frac{2\pi}{N}} \quad \text{where } m, n = 0 \text{ to } N-1 \tag{1}$$

The present modeformer circuit provides a matrix circuit implementation of equation (1) with very low circuit complexity. The modeformer circuit is based upon the decomposition of the matrix defined by equation (1), for any even N, into two matrices followed by a reordering matrix:

$$GN = Int \cdot GD \cdot Poe \tag{2}$$

$$Int = \begin{bmatrix} I & D\left[\frac{N}{2}\right] \\ I & -D\left[\frac{N}{2}\right] \end{bmatrix} \tag{3}$$

Where I is an identity matrix and D is a phase shift matrix (i.e., a matrix with a non-zero phase shift term):

$$DN = \begin{bmatrix} 1 & 0 & 0 & \cdots & 1 \\ 1 & e^{2\pi\frac{1}{N}} & 0 & 0 & 1 \\ 1 & 0 & e^{2\pi\frac{2}{N}} & 0 & 1 \\ \vdots & 0 & 0 & \ddots & \vdots \\ 1 & 0 & 0 & \cdots & e^{2\pi\frac{(N/2)-1}{N}} \end{bmatrix} \tag{4}$$

$$GD = \begin{bmatrix} G\left[\frac{N}{2}\right] & 0 \\ 0 & G\left[\frac{N}{2}\right] \end{bmatrix} \tag{5}$$

-continued $$Poe = \begin{bmatrix} 1 & 0 & 0 & 0 & \cdots & 0 \\ 0 & 0 & 1 & 0 & \ldots & 0 \\ \vdots & \vdots & \vdots & \vdots & \vdots & \vdots \\ 0 & 1 & 0 & 0 & \cdots & 0 \\ \vdots & \vdots & \vdots & \vdots & \vdots & \vdots \\ 0 & 0 & 0 & 0 & \cdots & 1 \end{bmatrix} \tag{6}$$

For example, for the N=6 case:

$$Poe = \begin{bmatrix} 1 & 0 & 0 & 0 & 0 & 0 \\ 0 & 0 & 1 & 0 & 0 & 0 \\ 0 & 0 & 0 & 0 & 1 & 0 \\ 0 & 1 & 0 & 0 & 0 & 0 \\ 0 & 0 & 0 & 1 & 0 & 0 \\ 0 & 0 & 0 & 0 & 0 & 1 \end{bmatrix} \tag{7}$$

$$GD = \begin{bmatrix} G3 & 0 \\ 0 & G3 \end{bmatrix} \tag{8}$$

$$G3 = \begin{bmatrix} 1 & 1 & 1 \\ 1 & e^{4*i*\frac{\pi}{6}} & e^{8*i*\frac{\pi}{6}} \\ 1 & e^{8*i*\frac{\pi}{6}} & e^{4*i*\frac{\pi}{6}} \end{bmatrix} \tag{9}$$

$$Int = \begin{bmatrix} I & D3 \\ I & -D3 \end{bmatrix} \tag{10}$$

$$D3 = \begin{bmatrix} 1 & 0 & 1 \\ 1 & e^{2\pi\frac{1}{6}} & 1 \\ 1 & 0 & e^{2\pi\frac{2}{6}} \end{bmatrix} \tag{11}$$

The elements of each phase shifting G matrix (e.g., G3) are given by equation (1). In a preferred embodiment, the first matrix, Int, is implemented as first and second sub-matrices:

$$Int = MT \cdot PS \tag{12}$$

Where MT is an N×N matrix having three N/2×N/2 identity sub-matrices, I, and one N/2×N/2 identity sub-matrix, −I. PS is an N×N diagonal matrix having an upper left identity portion and a lower right phase shift portion. For example, for the N=6 case:

$$MT = \begin{bmatrix} 1 & 0 & 0 & 1 & 0 & 0 \\ 0 & 1 & 0 & 0 & 1 & 0 \\ 0 & 0 & 1 & 0 & 0 & 1 \\ 1 & 0 & 0 & -1 & 0 & 0 \\ 0 & 1 & 0 & 0 & -1 & 0 \\ 0 & 0 & 1 & 0 & 0 & -1 \end{bmatrix} \tag{13}$$

and $$PS = \begin{bmatrix} 1 & 0 & 0 & 0 & 0 & 0 \\ 0 & 1 & 0 & 0 & 0 & 0 \\ 0 & 0 & 1 & 0 & 0 & 0 \\ 0 & 0 & 0 & 1 & 0 & 0 \\ 0 & 0 & 0 & 0 & e^{2*i*\frac{\pi}{6}} & 0 \\ 0 & 0 & 0 & 0 & 0 & e^{4*i*\frac{\pi}{6}} \end{bmatrix} \tag{14}$$

Turning now to FIG. 1, an example hardware implementation of the present modeformer circuit 100 is shown for N=6. The modeformer circuit 100 includes a first (Int) matrix circuit 102, a second (GD) matrix circuit 104 connected in series (cascaded) with the Int matrix circuit 102, and a third (Poe) matrix circuit 106 connected in series with the GD matrix 104. The Int matrix circuit 102 , according to equation (12) above, is shown in FIG. 1 efficiently implemented using a first (MT) sub-matrix 108 and a second (PS) sub-matrix (110). The GD matrix circuit 104, in FIG. 1, is implemented with first and second G(N/2) circuits 112 and 114 according to equations (8) and (9). N inputs 116 are connected to the first matrix circuit 102 while N outputs 118 are provided by the second matrix circuit 104.

Returning to the first matrix circuit 102, the MT sub-matrix circuit 108 may be implemented, for example, using an interconnected network of components including 180 degree hybrids. Each 180 degree hybrid has two inputs and two outputs. The first output is the sum of the two inputs, while the second output is the difference of the two inputs (or, equivalently, the sum of the first input with the second input phase shifted by 180 degrees). Thus, the first output of the MT sub-circuit 108, according to equation (13) is the first input plus the fourth input (generated by one output of a single 180 degree hybrid) Turning to the PS sub-matrix circuit 110, it connects in series to the MT sub-matrix circuit 108 at the locations requiring non-zero multiplication according to equation (14). As noted above, the PS sub-matrix circuit 110 includes an identity portion and a phase shift portion. The identity portion may be implemented in the PS sub-matrix circuit 110 using straight through transmission line interconnects. The phase shift portion may be implemented with an interconnected network of phase shift circuits. The basic phase shift circuits may be cascaded, if desired, to form the particular phase shift required. For example, two Pi/4 phase shift circuits may be used to produce an overall Pi/2 phase shift.

The GD matrix circuit 104 implements the non-zero multiplications (e.g., the phase shifts) according to equations (8) and (9) above. Thus, the GD matrix circuit 104 may be implemented using the first and second G(N/2) sub-circuits 112 and 114. Each of the G(N/2) sub-circuits 112 and 114 may be implemented, for example, using an interconnected network of phase shift circuits, passive quadrature couplers, and magic-T hybrids each of which is available from RF component manufacturers.

The Poe matrix circuit 106 is cascaded with the GD matrix circuit 104. The Poe matrix circuit represents a reordering of inputs to outputs. For example, according to equation (7) above, an input vector [x1, x2, x3, x4, x5, x6] on the N outputs 118 is reordered (using transmission line cross connects, for example) to [x1, x3, x5, x2, x4, x6] on the N mode outputs 120. The N mode outputs 120 provide the N modes generated by the sequence MT*PS*GD reordered by Poe, in a convenient order for subsequent processing.

Figure 2:
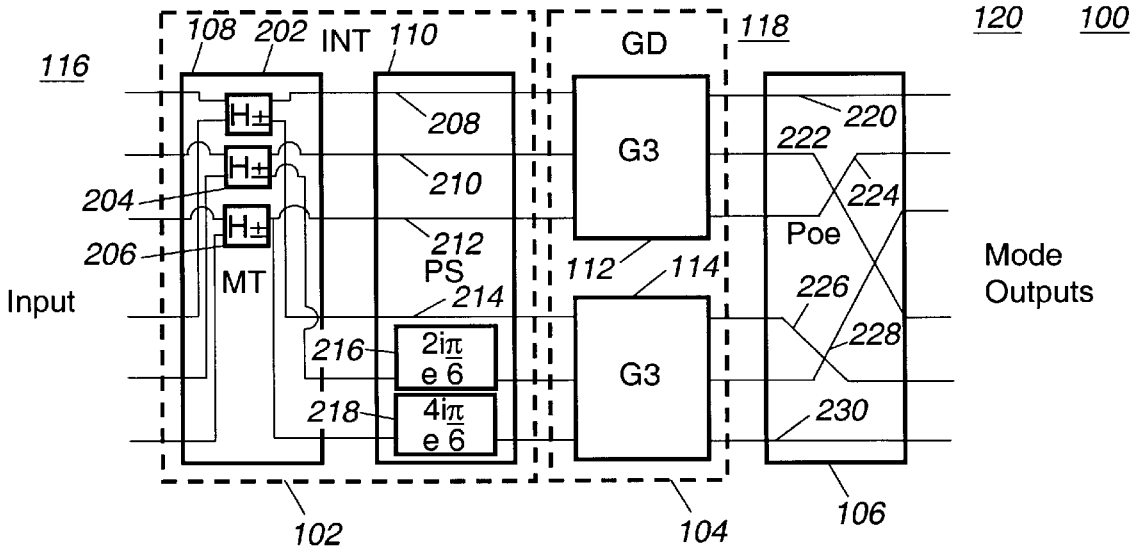
FIG. 2 illustrates several of the components and connections used to implement the modeformer circuit of FIG. 1.

Turning now to FIG. 2, that figure illustrates many of the components and connections used to implement the modeformer circuit shown in FIG. 1. FIG. 2 illustrates three 180 degree hybrids 202–206 (also known as magic-T inverters) that implement the MT matrix (equation (13)). Each hybrid 202–206 includes a + output that represents the sum of the two inputs, and a − output that represent the sum of the first input and a 180 degree phase shifted second input.

FIG. 2 also shows the transmission line connections 208–214 and phase shifters 216–218 that implement the PS matrix (equation 14)). The connections 208–214 are straight through connections corresponding to the identity matrix portion of PS, while the phase shifters 216–218 implement the phase shift portion of PS.

Although not illustrated in FIG. 2, the G3 matrices may also be implemented in a similar fashion using phase shifters, hybrids, and passive quadrature couplers according to equation (9). Finally, FIG. 2 illustrates the Poe matrix circuit using transmission lines 220–230. The transmission lines 220–230 perform the reordering operation discussed above (for example, the second output is the third input).

The present invention thus provides a modeformer circuit for any even N. In addition to its flexibility with respect to N, the present modeformer circuit provides an extremely efficient implementation of a modeforming circuit. The modularized construction allows modeformers with large N to be constructed from circuit modules designed for lower numbered modeformers. Thus, the complexity and cost of the modeformer circuit is greatly reduced over standard Butler matrix implementations, while at the same time reliability and manufacturability are greatly increased.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

What is claimed is:

1. A modeforming circuit for forming N mode signals from N input signals, the modeforming circuit comprising:

a first matrix circuit including N inputs and comprising a network of transmission lines and phase shifters implementing at least one N/2×N/2 identity matrix and at least one N/2×N/2 phase shift matrix; and a second matrix circuit connected in series with said first matrix circuit, said second matrix circuit comprising a network of phase shifters implementing at least one N/2×N/2 phase shift matrix, said second matrix circuit further comprising N outputs.

2. The modeforming circuit of claim 1, further comprising a third matrix circuit connected in series with said second matrix circuit, said third matrix circuit comprising a network of transmission lines implementing a reordering of said N outputs to N mode outputs.

3. The modeforming circuit of claim 1, wherein said first matrix circuit comprises a first matrix sub-circuit connected in series with a second matrix sub-circuit.

4. The modeforming circuit of claim 3, wherein said first matrix sub-circuit comprises a network of 180 degree hybrids.

5. The modeforming circuit of claim 4, wherein said second matrix sub-circuit comprises a network of phase shifters.

6. The modeforming circuit of claim 2, wherein said first matrix circuit comprises a first matrix sub-circuit connected in series with a second matrix sub-circuit.

7. The modeforming circuit of claim 6, wherein said first matrix sub-circuit comprises a network of 180 degree hybrids.

8. The modeforming circuit of claim 7, wherein said second matrix sub-circuit comprises a network of phase shifters.

9. A modeforming circuit for forming N mode signals from N input signals, the modeforming circuit comprising:

a first matrix circuit including N inputs and comprising a network of transmission lines and phase shifters implementing at least one N/2×N/2 identity matrix and at least one N/2×N/2 phase shift matrix; and a second matrix circuit connected in series with said first matrix circuit, said second matrix circuit comprising a plurality of N/2×N/2 phase shift sub-circuits, said second matrix circuit further comprising N outputs.

10. The modeforming circuit of claim 9, further comprising a third matrix circuit connected in series with said second matrix circuit, said third matrix circuit comprising a network of transmission lines implementing a reordering of said N outputs to N mode outputs.

11. The modeforming circuit of claim 9, wherein said second matrix circuit comprises two N/2×N/2 phase shift sub-circuits, each having N/2 inputs and N/2 outputs.

12. The modeforming circuit of claim 9, wherein said first matrix circuit comprises a first matrix sub-circuit connected in series with a second matrix sub-circuit.

13. The modeforming circuit of claim 12, wherein said first matrix sub-circuit comprises a network of 180 degree hybrids.

14. The modeforming circuit of claim 13, wherein said second matrix sub-circuit comprises a network of phase shifters.

15. The modeforming circuit of claim 10, wherein said first matrix circuit comprises a first matrix sub-circuit connected in series with a second matrix sub-circuit.

16. The modeforming circuit of claim 15, wherein said first matrix sub-circuit comprises a network of 180 degree hybrids.

17. The modeforming circuit of claim 16, wherein said second matrix sub-circuit comprises a network of phase shifters.

18. A method for forming N mode signals from N input signals, the method comprising:

applying N antenna input signals to a network of transmission lines and phase shifters implementing at least one N/2×N/2 identity matrix and at least one N/2×N/2 phase shift matrix and forming a first matrix circuit producing a first intermediate set of N signals; and applying the first intermediate set of N signals to a network of phase shifters implementing at least one N/2×N/2 phase shift matrix in a second matrix circuit connected in series with the first matrix circuit.

19. The method of claim 18, wherein the step of applying N antenna input signals comprises applying at least one of the N input signals to a 180 degree hybrid.

20. The method of claim 19, wherein the step of applying N antenna input signals further comprises phase shifting at least one of the N input signals applied to the 180 degree hybrid.

* * * * *